US005959227A

United States Patent [19]

Shapiro

[11] Patent Number: 5,959,227

[45] Date of Patent: Sep. 28, 1999

[54] MUSIC CYMBAL MUTE DEVICE

[76] Inventor: Victor Shapiro, 1 Landmark Sq., Port Chester, N.Y. 10573

[21] Appl. No.: 09/053,263

[22] Filed: Apr. 1, 1998

[51] Int. Cl.[6] ..... G10D 13/02

[52] U.S. Cl. ..... 84/411 M; 84/422.3

[58] Field of Search ..... 84/411 M, 422.3, 84/453, 422.1, 422.2

[56] References Cited

U.S. PATENT DOCUMENTS

| | | | |
|---|---|---|---|
| 1,596,495 | 8/1926 | La Londe . | |
| 4,037,509 | 7/1977 | Slomovits . | |
| 4,102,235 | 7/1978 | Le Masters . | |
| 4,216,696 | 8/1980 | Alexis, Jr. . | |
| 4,671,158 | 6/1987 | Saputo . | |
| 4,776,254 | 10/1988 | Cruz | 84/422.1 |
| 4,911,056 | 3/1990 | Belli et al. . | |
| 5,561,254 | 10/1996 | Huffer . | |
| 5,637,819 | 6/1997 | Rogers . | |

*Primary Examiner*—William M. Shoop, Jr.
*Assistant Examiner*—Shih-yung Hsieh
*Attorney, Agent, or Firm*—Leo Zucker

[57] ABSTRACT

A mute device for a cymbal of the kind mounted on a cymbal post. The device include a strike plate assembly having a mount for engaging an upper part of a cymbal post, and at least one foot projecting from the strike plate assembly to rest on the cymbal. A cymbal mute assembly projects from the strike plate assembly to receive part of an outer circumference of the cymbal. The mute assembly includes a muting part of sound dampening material arranged to contact the cymbal in a rest position, and a strike piece arranged to strike the cymbal in response to a percussion force on the strike plate assembly.

11 Claims, 2 Drawing Sheets

MUSIC CYMBAL MUTE DEVICE

BACKGROUND OF THE INVENTION

1. Field of the Invention

The present invention relates to devices for muting the sound intensity of musical instruments, and particularly to a mute device for a cymbal.

2. Discussion of the Known Art

Musicians who must practice on their instruments at home, where the neighbors may not always care to listen, have to make certain compromises. For drummers, a music drum mute device is presently available and is disclosed in my co-pending U.S. patent application Ser. No. 08/964,105 filed Nov. 6, 1997. Most drum sets also include cymbals of the so-called ride, crash or high-hat kind, and a need remains for a mute device that works effectively for such cymbals without significantly distorting the natural tonal qualities of the cymbals. There is also a need for a cymbal mute device that occupies relatively little room and which can be carried conveniently with the cymbals themselves.

U.S. Pat. No. 4,776,254 (Oct. 11, 1988) shows a damper assembly for a cymbal, including two opposed clamp members which are supported by outside linkage about the outer circumference of the cymbal. The clamp members must be operated by an activating mechanism in order to dampen sound emitted by the cymbal when struck. The supporting linkage does occupy a significant amount of room next to the cymbal, however.

U.S. Pat. No. 4,037,509 (Jul. 26, 1977) discloses a practice cymbal cover that lies on the surface of a cymbal. U.S. Pat. No. 1,596,495 (Aug. 17, 1926) shows a cymbal holder for attachment to a drum rim, including a padded cup for muting the cymbal. See also U.S. Pat. Nos. 4,102,235 (Jul. 25, 1978); 5,637,819 (Jun. 10, 1997); and 4,671,158 (Jun. 9, 1987).

According to the invention, a mute device for a cymbal includes a strike plate assembly having a mount for engaging a cymbal stand post, and at least one foot projecting from the strike plate assembly to rest on the cymbal. A cymbal mute assembly projects from the strike plate assembly to receive part of an outer circumference of the cymbal. The mute assembly includes a muting block of sound dampening material arranged operatively to contact the cymbal in a rest position, and a strike piece for striking the cymbal in response to a percussion force on the strike plate assembly.

For a better understanding of the invention, reference is made to the following description taken in conjunction with the accompanying drawing and the appended claims.

DETAILED DESCRIPTION OF THE INVENTION

Figures 1, 2:
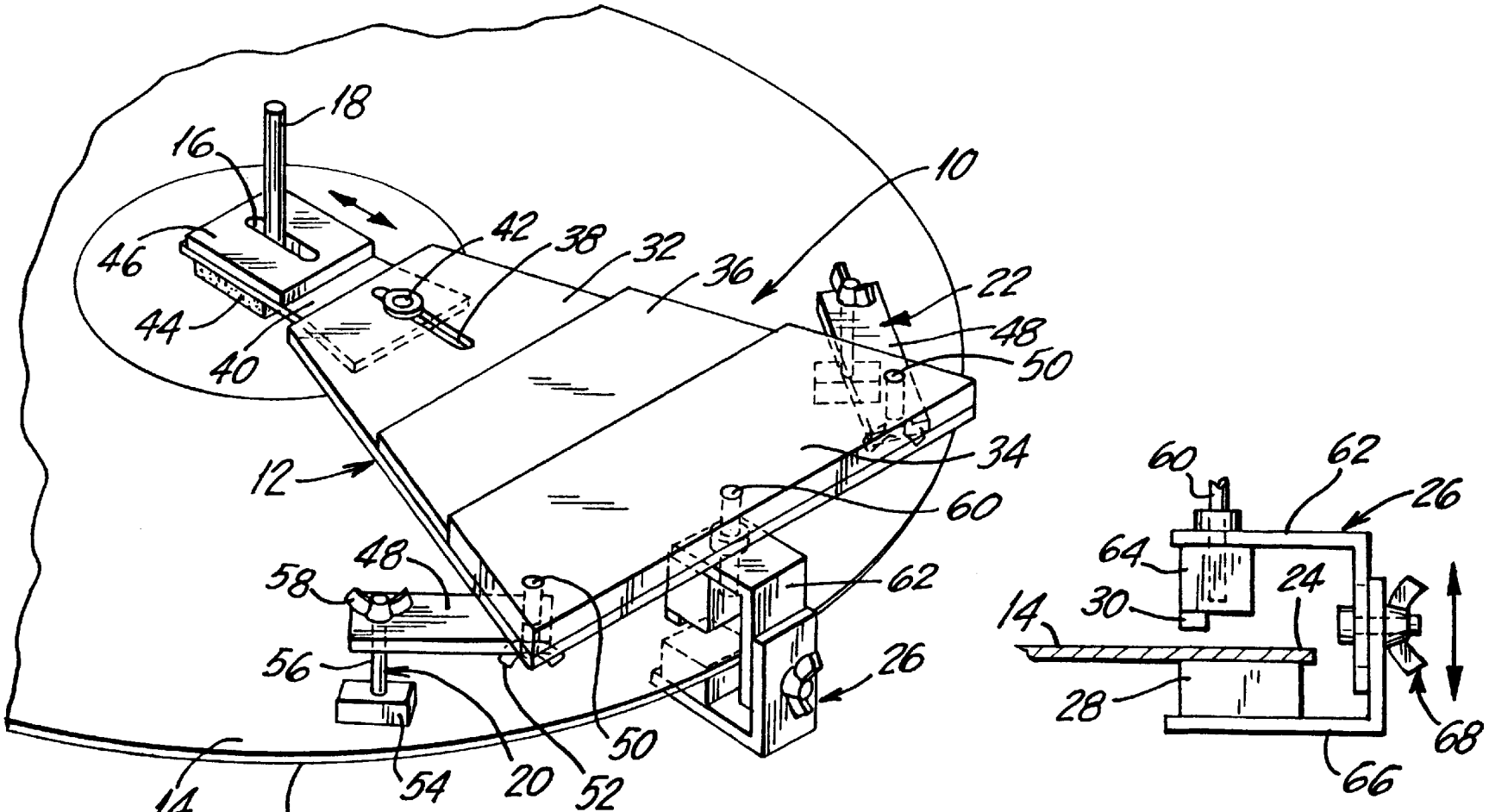
FIG. 1 is a perspective view of a music cymbal mute device according to the invention.
FIG. 2 is an enlarged side view of a cymbal mute assembly in the device of FIG. 1.

FIG. 1 is a perspective view of a music cymbal mute device 10 according to the invention. The device 10 includes a strike plate assembly 12 that is constructed and arranged to rest atop a cymbal 14. The strike plate assembly 12 has a stand post mount 40 at one end for engaging an upper part of a cymbal stand post 18.

A pair of feet 20, 22 project from beneath the strike plate assembly 12 to rest against a top surface of the cymbal 14, at positions radially inward from the cymbal's outer circumference 24. A cymbal mute assembly 26 also projects beneath the strike plate assembly 12, to receive part of the outer circumference 24 of the cymbal 14.

FIG. 2 is an enlarged side view of the cymbal mute assembly 26. The assembly 26 has a muting block 28 of sound dampening material in the form of, for example, an elastomeric block. Assembly 26 also includes a strike piece 30 of hard material such as wood or acrylic plastics. Preferably, the strike piece 30 is a small hickory wood block measuring about ¾ inch long, 3/16 inch wide, and about ⅛ to 3/16 inch high. The length of the strike piece 30 is aligned to be perpendicular to the radial direction of the cymbal 14 when the device 10 is mounted on the cymbal as explained below.

In a normal rest position shown in FIG. 2, the muting block 28 contacts a bottom surface of the cymbal 14, near the cymbal's outer circumference 24. In the rest position, the strike piece 30 forms a gap of preferably between about 1/32 to 1/16 inch from a top surface of the cymbal 14, opposite the side of the muting block 28. It has been discovered that such a gap permits the strike piece 30 to strike the top surface of the cymbal 14 when the strike plate assembly 12 is subjected to a percussion force, for example, by a drum stick. Sound emitted from the cymbal 14 is then attenuated primarily by the action of the muting block 28 contacting the bottom surface of the cymbal. The feet 20, 22 resting on the cymbal 14 may also act to attenuate its normal sound level. Further construction details of the cymbal mute device 10 now follow.

The strike plate assembly 12 of the mute device 10, comprises a generally trapezoidal-shaped base sheet 32. The base sheet 32 is formed of, e.g., a polyvinyl chloride (PVC) plastics sheet of at least about 0.09 inches thickness, or equivalent material. A strike pad 34 made from, e.g., a sheet of gum rubber is adhered over a portion of the base sheet 32 including the wide end of the sheet 32. A protective layer 36 made of, for example, blown plastics sheet material covers a mid portion of the base sheet 32 beginning from an edge of the strike pad 34. The base sheet 32 has an elongate slot 38 in a narrow end portion of the sheet, the slot 38 extending perpendicular to the wide and the narrow ends of the base sheet 32.

The stand post mount 40 can be formed from a sheet of the same material as the base sheet 42. The mount 40 is joined to the base sheet 32 by a fastener 42 that extends through the slot 38 in the base sheet, and an end portion of the mount 40. An opposite end portion of the mount 40 has the earlier mentioned opening 16 in the form of an elongate slot or slit, for receiving the cymbal stand post 18. A guard pad 44 of, e.g., sponge rubber is adhered on a bottom surface of the mount 40 so that the mount will not scratch or mar the top surface of the cymbal 14 against which it rests. A top layer 46 of, e.g., neoprene sheet rubber is adhered on top of the mount 40, with the slot 16 being cut in the layer 46. Preferably, the opening 16 is a narrow slit in which the cymbal stand post is tightly fitted, so that movement of the narrow end of the device 10 is restrained by the post 18.

Each of the feet 20, 22 has a support link 48 which may be formed of the same material as the base sheet 32. Each link 48 is mounted for adjustable swinging movement relative to the base sheet 32 by a fastener 50, e.g., a threaded screw, and a mating wing nut 52. As shown in FIG. 1, the support links 48 are at each side of the base sheet 32 near the wide end of the sheet.

A shoe 54 in the form of, for example, a rubber block projects down from the free ends of the links 48. The height of each link 48 above an associated shoe 54 is preferably adjustable. For example, each shoe 54 may have a threaded rod 56 extending upwardly to engage a nut (not shown) on a bottom surface of each link 48. Once the rod 56 is turned to set the shoe 54 at a desired position, a wing nut 58 on the top surface of the link is tightened by the user.

The cymbal mute assembly 26 projects downward from the wide end of the base sheet 32, preferably at a point mid-way between the sides of the sheet 32. A fastener 60 joins an upper right-angle part 62 of the mute assembly 26 firmly to the wide end of the base sheet 32. Preferably, the fastener 60 extends through an opening in the part 62 and tightly engages a block 64 made of, e.g., an acrylic plastics material. The strike piece 30 projects from a bottom face of the block 64 to confront the top surface of the cymbal 14, as shown in FIG. 2. As mentioned, a gap of preferably between about 1/16 to 1/32-inch is defined between the strike piece 30 and the cymbal top surface, in the rest position of FIG. 2.

The mute assembly 26 has a lower right angle part 66, a bottom leg of which has the muting block 28 adhered thereon. The two right angle parts 62, 66 are joined to one another by, for example, a fastener and wing-nut arrangement 68 that permits the lower part 66 to be adjusted in the vertical direction in FIG. 2 relative to the part 62, and, thus, to allow the muting block 28 to be set to contact the bottom surface of the cymbal 14 in the rest position in FIG. 2.

In use, before placing the mute device 10 on the cymbal 14 for the first time, the fastener 42 joining the base sheet 32 with the stand post mount 40 is loosened. The outer circumference 24 of the cymbal 14 is passed into the gap between the muting block 28 and the strike piece 30 of the mute assembly 26. The mount 40 is manipulated so that the top end of the cymbal stand post 18 is fitted in the mount opening 16, and the guard pad 44 rests firmly atop the cymbal 14. The fastener 42 is then tightened.

The support feet 20, 22 are adjusted by swiveling the links 48 either toward or away from the stand post 18, thus urging the shoes 54 against the top surface of the cymbal 14. This in turn urges the bottom surface of the cymbal at its outer circumference against the muting block 28, as in FIG. 2. The right-angle parts 62, 66 of the mute assembly may deflect or may be set via the fastener arrangement 68 between them, so that the mentioned 1/16 to 1/32-inch gap is defined between the strike piece 30 and the cymbal 14.

When the strike pad 34 of the device is struck by a drum stick, the present mute device 10 will attenuate the amplitude or intensity of the sound of the cymbal, leaving the natural spectral sound or tonal qualities of the cymbal substantially undistorted. The degree of attenuation or muting of sound from the cymbal 14 may be varied by re-setting the fastener arrangement 68 joining the right-angle parts 62, 66, to change the contact force applied by the muting block 28 on the bottom surface of the cymbal 14.

Figure 3:
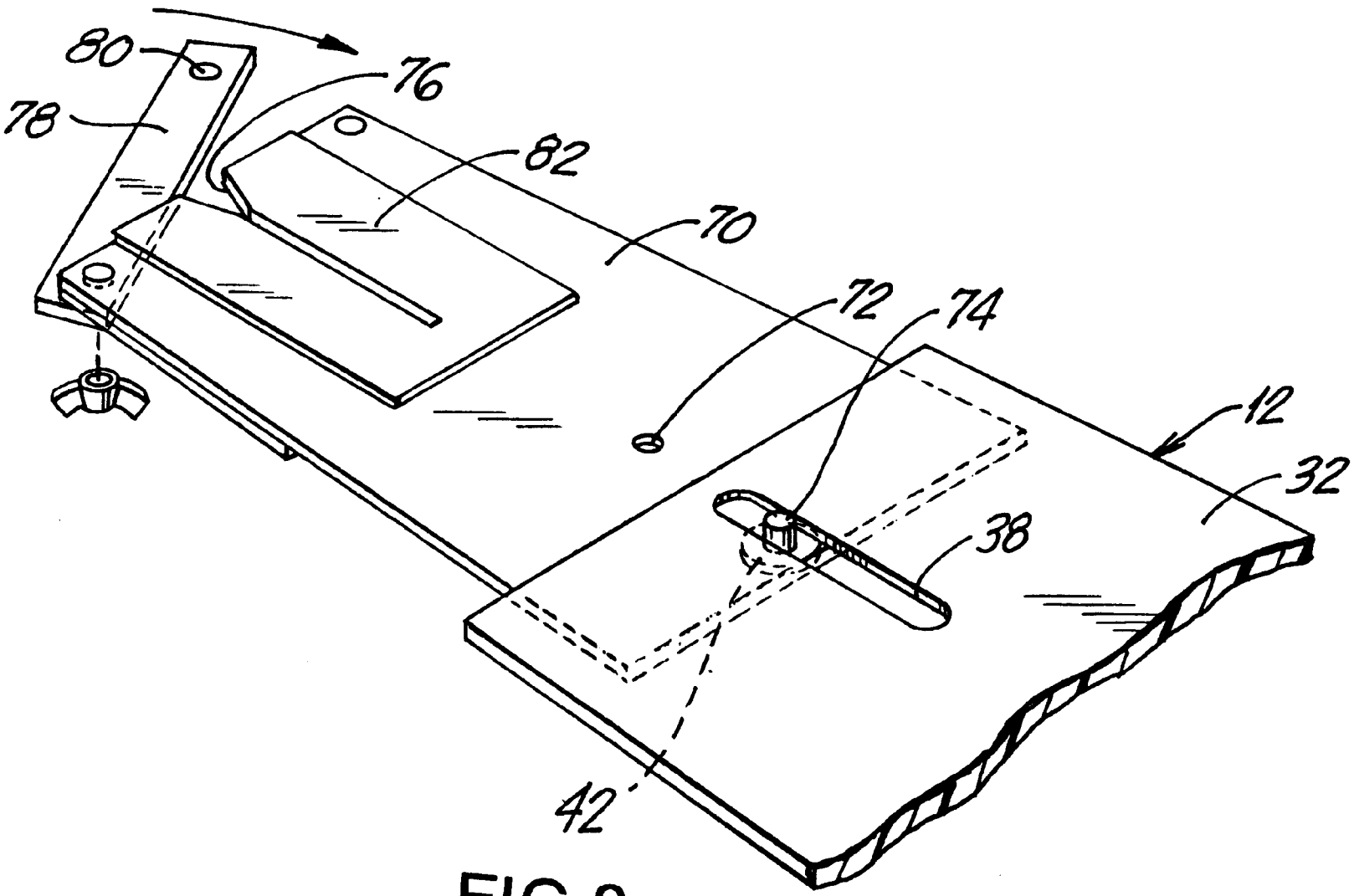
FIG. 3 is a perspective view of an alternate construction for a cymbal stand post mount in the device of FIG. 1.

FIG. 3 is a perspective view of an alternate construction of the stand post mount 40 in FIG. 1. In FIG. 3, a post mount 70 is formed of a PVC plastics material the same or similar to the material of the base sheet 32 in FIG. 1. To allow for a greater range of adjustability for the mute device 10 with respect to different diameter size cymbals, the mount 70 may have a number of openings such as at 72, 74, for receiving the fastener 42 in a selected one of the openings 72, 74. That is, for smaller size cymbals, the opening 72 is brought in registration with the slot 38, the fastener 42 is inserted in the slot 38 and the opening 72, and the mount 70 is positioned in a radial direction relative to the cymbal so that the stand post 18 can be tightly fitted in a slit opening 76 formed at the free end of the mount 70.

For larger diameter cymbals, the opening 74 in the mount 70 is aligned beneath the slot 38 in the base sheet of the strike plate assembly 12, the fastener 42 is inserted in the slot 38 and the opening 74, and the mount 70 is extended an amount sufficient to permit the cymbal stand post 18 to be fitted tightly in the slit opening 76 of the mount 70. The slit opening 76 is preferably formed in a sheet 82 of neoprene rubber that overlies a larger opening in the free end of the mount 70.

A locking bar 78 is mounted for pivotal movement relative to one free end corner of the mount 70. When the cymbal stand post 18 is pressed into the slit opening 76, the bar 78 is swung in the direction shown in FIG. 3, and an opening or dimple 80 at the free end of the bar 78 engages a protrusion projecting downward from the opposite free end corner of the mount 70, thus locking the mount 70 onto the cymbal stand post 18.

The present mute device 10 may be used not only with ride or crash cymbals, but also with so-called high-hat cymbals wherein a stationary lower cymbal and a moveable upper cymbal are mounted on a common post axis. For such high-hat cymbals, the present mute device 10 is used by tilting the upper cymbal downward at a point on its circumference toward the lower cymbal, and passing the confronting edges of both cymbals into the gap between the muting block 28 and the strike piece 30 of the mute assembly 26. The right-angle parts 62, 66 of the assembly 26 are adjusted so that the edges of both cymbals touch one another within the assembly 26. When the upper cymbal is pulled down to strike the lower cymbal during play, the sound level emitted by both cymbals is attenuated without significant distortion of the natural tonal characteristics of the cymbals.

While the foregoing description represents preferred embodiments of the invention, it will be obvious to those skilled in the art that various changes and modifications may be made, without departing from the spirit and the scope of the invention pointed out by the following claims.

I claim:

1. A mute device for a cymbal of the kind mounted on a cymbal post, comprising:

a strike plate assembly having a mount for engaging an upper part of a cymbal post;

at least one foot projecting from the strike plate assembly to rest on the cymbal; and a cymbal mute assembly projecting from the strike plate assembly to receive part of an outer circumference of the cymbal, the mute assembly including;

a muting part of sound dampening material dimensioned and arranged to contact the cymbal in a rest position, and a strike piece dimensioned and arranged to strike the cymbal in response to a percussion force on the strike plate assembly.

2. A cymbal mute device according to claim 1, wherein said strike plate assembly comprises a generally trapezoidal-shaped base sheet.

3. A cymbal mute device according to claim 1, wherein said mount has an opening for receiving the upper part of the cymbal post.

4. A cymbal mute device according to claim 1, wherein said foot includes a support link mounted for adjustable swinging movement relative to said strike plate assembly.

5. A cymbal mute device according to claim 4, wherein said foot includes a shoe constructed and arranged to be urged against a top surface of a cymbal.

6. A cymbal mute device according to claim 5, including a threaded rod member that extends from said shoe to engage the support link.

7. A cymbal mute device according to claim 1, wherein said strike plate assembly comprises a base sheet, and said mount and said base sheet are constructed and arranged to be fastened to one another at different positions to accommodate different size cymbals.

8. A cymbal mute device according to claim 7, wherein one of said base sheet and said mount has an elongate slot for receiving a fastener that joins the base sheet and the mount to one another.

9. A cymbal mute device according to claim 1, wherein said strike piece comprises a wood material.

10. A cymbal mute device according to claim 9, wherein said wood material is hickory.

11. A cymbal mute device according to claim 1, wherein said cymbal mute assembly is constructed and arranged so that the muting part contacts a bottom surface of the cymbal in the rest position, and the strike piece contacts a top surface of the cymbal in response to said percussion force.

* * * * *